United States Patent [19]

Perrott

[11] 4,203,369

[45] May 20, 1980

[54] TRANSPORTATION SYSTEMS

[76] Inventor: Francis C. Perrott, The Manor House, South Cerney, Cirencester, Gloucestershire, England

[21] Appl. No.: 837,213

[22] Filed: Sep. 27, 1977

[30] Foreign Application Priority Data

Sep. 28, 1976 [GB] United Kingdom ..... 40122/76
Jan. 15, 1977 [GB] United Kingdom ..... 1639/77

[51] Int. Cl.[2] ..... E01B 7/04; E01B 25/26

[52] U.S. Cl. ..... 104/130; 104/94; 104/96; 104/103; 105/155; 213/75 R

[58] Field of Search ..... 104/88, 89, 91, 94, 104/96, 102, 103, 130, 245, 247; 213/75 R, 75 TC, 175, 176; 64/30 R; 105/155

[56] References Cited

U.S. PATENT DOCUMENTS

| | | | |
|---|---|---|---|
| 2,170,296 | 8/1939 | Frank et al. | 105/155 X |
| 3,275,109 | 9/1966 | Ganley | 64/30 R X |
| 3,348,496 | 10/1967 | Klamp et al. | 104/96 |
| 3,780,666 | 12/1973 | Perrott | 104/130 X |
| 3,783,793 | 1/1974 | Perrott et al. | 104/130 |
| 3,901,160 | 8/1975 | Auer, Jr. | 104/96 X |
| 3,913,491 | 10/1975 | Auer, Jr. et al. | 104/96 X |
| 3,946,974 | 3/1976 | Stiefel et al. | 104/130 X |
| 4,015,539 | 4/1977 | Hamada | 104/130 |
| 4,072,110 | 2/1978 | Jayawant | 104/130 X |

FOREIGN PATENT DOCUMENTS

| | | | |
|---|---|---|---|
| 577905 | 7/1976 | Switzerland | 104/94 |

OTHER PUBLICATIONS

D. J. Steger, "Split Ring Torque Limited Slip Clutch", *IBM Technical Disclosure Bulletin,* 4–1973.

*Primary Examiner*—Randolph A. Reese
*Attorney, Agent, or Firm*—Young & Thompson

[57] ABSTRACT

In a transportation system of the kind in which vehicles move along a guideway which includes diverging junctions and a vehicle-mounted track selection mechanism can be set to control which side of the junction the vehicle is to follow, both by an on-board operating member and by an on-guideway operating member. In normal use, the on-guideway operating member would be set to cause the vehicle to take the route with the highest traffic level so that intervention by the on-board operating member is necessary only when divergence from such route is desired.

11 Claims, 11 Drawing Figures

80
79
33
32
19
20
34
29
52
51
50
47
49
48
28
55
57
56
54
53
59
60
58
64
63
62
61
65

TRANSPORTATION SYSTEMS

This invention relates to transportation systems and has for its object the provision of improved means for obtaining efficient routing of a vehicle.

According to the invention, in one aspect, a transportation system comprises a vehicle movable along a guideway which includes a diverging junction, guidance means for affording guidance to said vehicle for travel thereof to either side of said junction, vehicle-mounted track selection means for selecting which side of the junction the vehicle is to follow and means whereby said track selection means is independently operable both by an on-board operating member and by an on-guideway operating member, and retained in position to select a chosen side of the junction until changed by either of said operating means.

According to the invention, in another aspect, a transportation system comprises two vehicles movable along a guideway which includes a diverging junction, guidance means for affording guidance to said vehicles for travel thereof to either side of said junction, vehicle mounted track selection means for selecting which side of the junction each vehicle is to follow, and means whereby said track selection means is operable by an on-board operating member, wherein each vehicle has a buffer and a coupling member at one end, one of the coupling members comprises a roller with a part-spherical surface and a vertical axis, and the other coupling member has a concave cylindrical surface having a horizontal axis and substantially the same radius of curvature as the part-spherical surface and adapted to be engageable therewith when the coupling formed thereby is in tension, the ends of the cylindrical surface being unbounded whereby if the vehicles select and follow different sides of a diverging junction, they automatically become uncoupled by the transverse relative motion of said roller relative to said cylindrical surface.

Hereinafter, the term "on-board operating" is used to denote switching by means located on a vehicle and the term "on-guideway operating" is used to denote switching by means located on the guideway.

Means are preferably provided whereby, in the event that the on-board operating member and the on-guideway operating member should be set to direct the track selection means and thereby the vehicle to different sides of the branch, the on-guideway operating member over-rides the on-board operating member.

The transportation system may include converging guideway sections which meet at a junction and the guideway leading to one side of the junction may then be preceded by a fixed on-guideway operating means so that the vehicle-mounted track selection means mounted on the vehicle is always caused to select the same guidance means past the junction.

Figure 1:
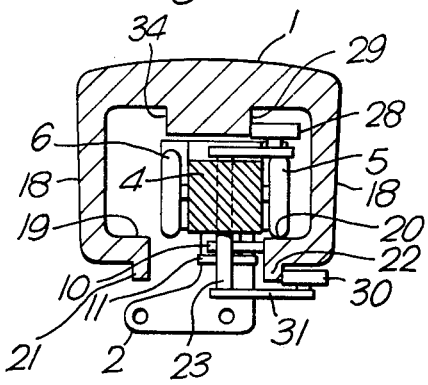
Figure 3:
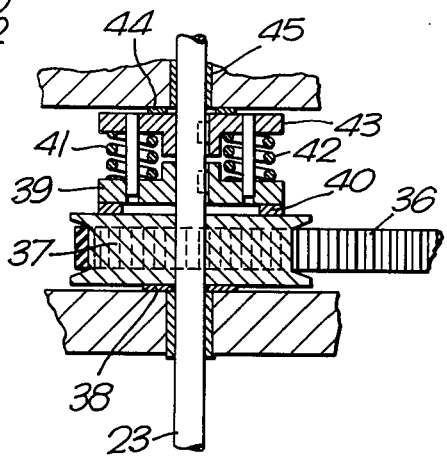
Figure 2:
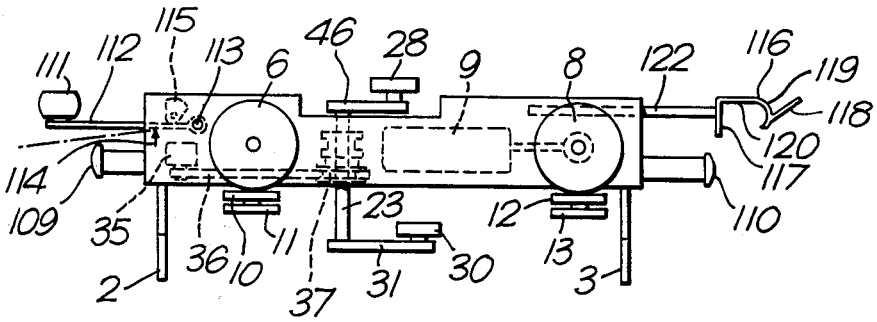
Figure 4:
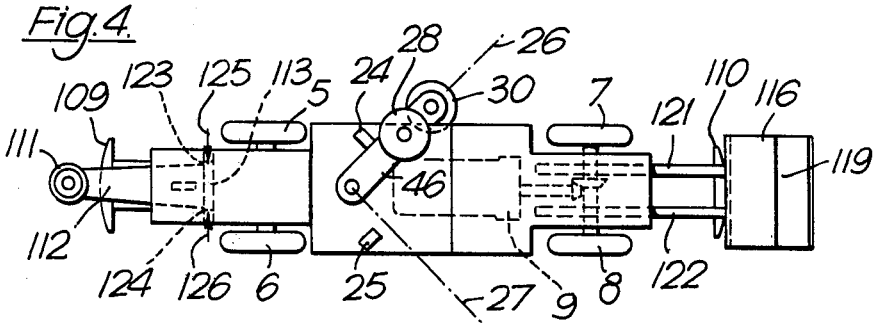
Figures 5, 6, 7, 8, 9:
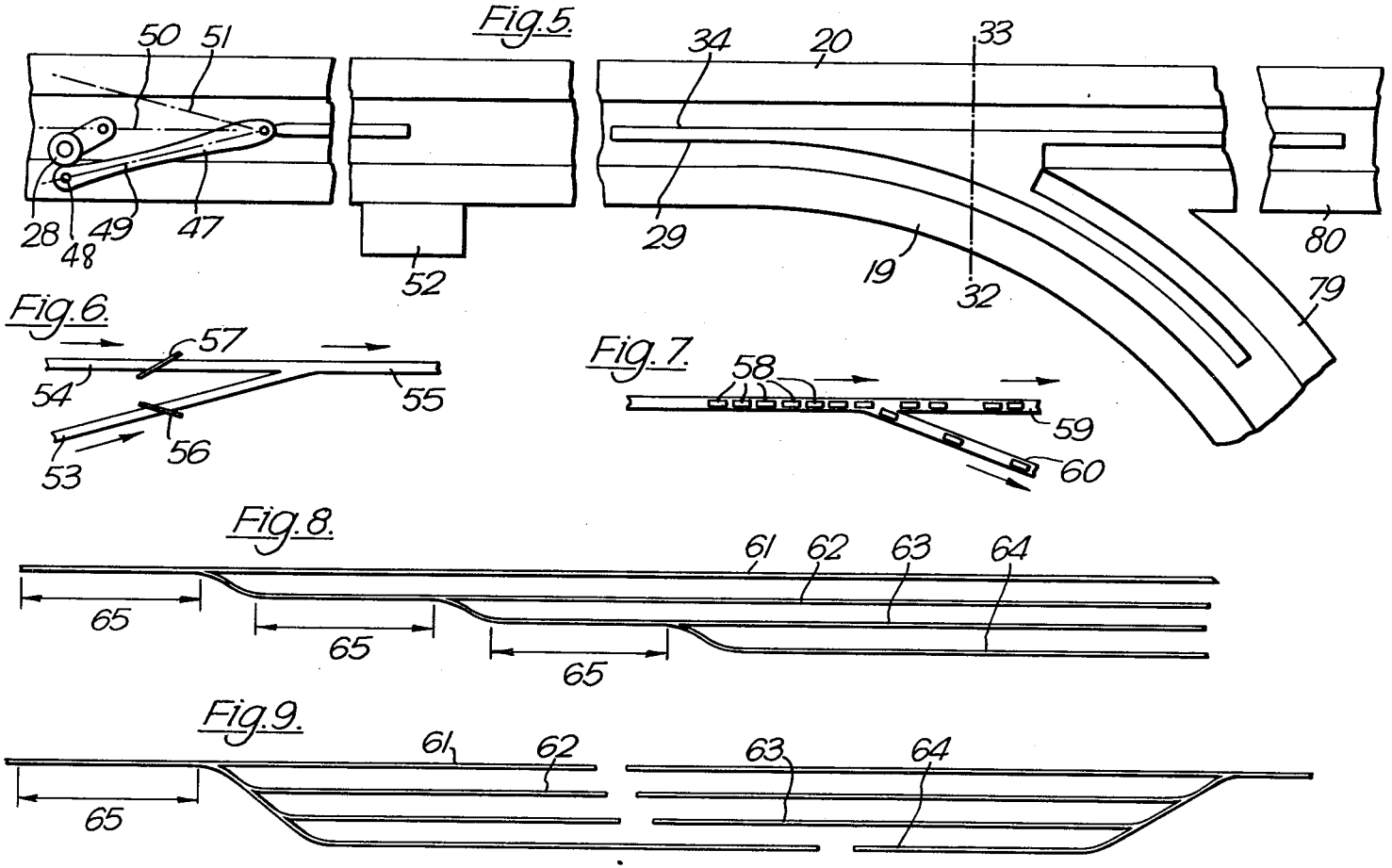
Figure 10:
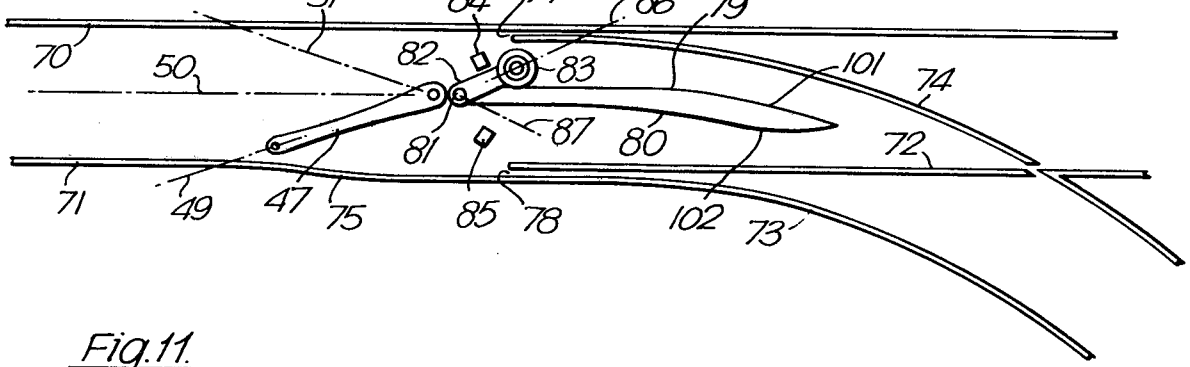
Figure 11:
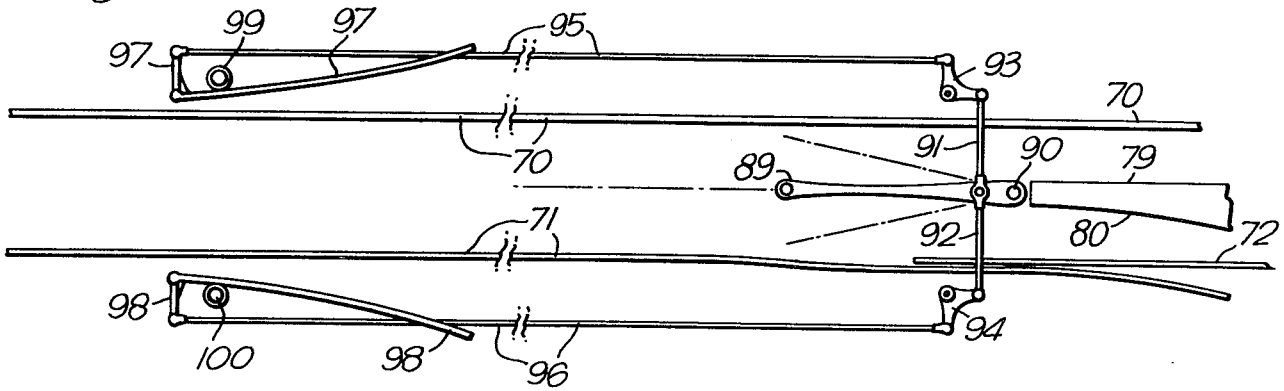

The invention will not be described by way of example with reference to the accompanying drawings in which:

FIG. 1 is a transverse sectional view of the suspension means of part of a monorail vehicle and a guideway, FIG. 2 is a side view of the wheeled carriage shown in FIG. 1, FIG. 3 is a detail view of part of the track selection operating means, of the carriage shown in FIG. 1, FIG. 4 is a plan view of the carriage as shown in FIG. 1, FIG. 5 is a schematic representation of a guideway section, viewed from above, FIG. 6 illustrates a guideway junction, FIG. 7 illustrates another guideway junction, FIGS. 8 and 9 illustrate alternative platform configurations, FIG. 10 is a plan view of a junction in a modified form of conventional railway, and FIG. 11 is a plan view of a junction in another modification to a conventional railway.

Referring first to FIGS. 1 to 4, FIG. 1 shows a hollow beam 1 beneath which a mono-rail passenger cabin (not shown) is suspended from brackets 2 and 3 (FIG. 2) disposed beneath and supported from each end of a wheeled carriage 4. The carriage 4 has four support wheels 5, 6, 7 and 8 which are disposed in two pairs and rotate about horizontal axes disposed adjacent the front and rear of the carriage. The wheels 7 and 8 are driven by an electric motor 9. The carriage 4 also has four guide wheels 10, 11, 12 and 13 which are arranged for rotation about vertical axes and cooperate with vertical guide surfaces for vehicle guidance purposes.

The vehicle cabin is hung from the brackets 2 and 3 with damping means (not shown) provided to counter rolling or vertical movement of the cabin relative to the brackets 2 and 3.

The beam 1 is an inverted channel section with side walls 18 which are constantly spaced except at track junctions or branches and which have inwardly extending formations at their lower ends to provide track surfaces such as 19 and 20 on which the drive wheels 5 to 8 of the carriage are supported. However, the cross-section of FIG. 1 is taken at a junction, where the gap between the track surfaces 19 and 20 is widened so that only the wheels 5 and 7 are in contact with their track surface 20. The formations providing the surfaces 19 and 20 are integral with downward extensions 21 and 22 of the beam 1. Normally the guide wheels 11 and 13 engage with the extension 21 and the guide wheels 10 and 12 with the extension 22 but at the junction shown in FIG. 1, only the wheels 10 and 12 are in contact with the extension 22.

A two-throw crankshaft 23 carried on the carriage 4 is rotatable relative thereto about a vertical axis between positions determined by stops 24 and 25 and represented in FIG. 4 by the lines 26 and 27. The position of the crankshaft 3 determines the route taken by the carriage at a junction and, when the crankshaft 23 is in the position shown, an upper guide wheel 28 engages a vertical guide surface 29 FIG. 1 to constrain the carriage 4 to follow the path corresponding to that guide surface and at the same time to provide a balancing couple which counteracts the couple that is produced as a result of asymmetrical support of the carriage by the wheels 5 and 7 as it traverses the junction. A lower guide wheel 30 mounted on a crank 31 at the lower end of the crankshaft 23 engages the outer surface of the downward extension 22 to ensure positive engagement of the carriage with the beam 1 and prevent derailment of the vehicle in the event that it should be subjected to strong transverse winds.

Guidance of a carriage at a junction will be more easily understood with reference to FIG. 5 which is a diagrammatic plan view showing selected portions of the beam 1. Traffic moves from left to right in FIG. 5 past a branch 32 and the beam has support surfaces 19 and 20 as shown in FIG. 1, the section line for FIG. 1 being represented by the line 33—33 in FIG. 5. In FIG.

1, the guide wheel 28 of the crankshaft has engaged the guide surface 29 and the carriage has accordingly been routed to the right at the track branch. On the other hand, if the guide wheel 28 carried by the crankshaft 18 had been in its other limiting position, it would have engaged guide surface 34 and the carriage would have been routed to the left at the branch. As previously mentioned, the carriage is temporarily supported from one side only while passing the junction being both guided and kept upright by the wheel 28 until either the wheels 6 and 8 reach a supported surface 79 beyond the junction if the carriage is routed to the right or the wheels 5 and 7 reach a support surface 80 if the carriage is routed to the left.

Operation of the crankshaft 23 is controlled by a geared motor 35 through a toothed belt 36 and a wheel 37 engaged by the belt. As shown in FIG. 3, the wheel 37 is mounted on the shaft 23 and is rotatable relative thereto. The wheel 37 is supported against movement axially of the shaft 23 by means of a thrust ring 38 and is arranged to drive a collar 39 through the intermediary action of a friction ring 40. The ring 40 is of relatively large diameter and the collar 39 is urged into engagement therewith by helical springs 41 and 42.

The collar 39 is slidable axially relative to the shaft 23 but is fixed against rotation relative thereto by, for example, a splined or keyed engagement with the shaft. The springs 41 and 42 seat against a compression collar 43 which is keyed to the shaft 23 and is located axially by means of a ring 44 of frictional material which acts to transmit the axial loads of the springs 41 and 42 from the collar 43 to the surface of a fixed member containing a bearing bush 45. The ring 44 is of less diameter than the ring 40 so that, as the two rings 44 and 40 are loaded by the same springs and are thus subjected to the same axial forces, the ring 44 being of less diameter, will slip before the ring 40.

In normal operation, the drive from the belt 36 is transmitted through the wheel 37, the friction ring 40 and collar 39 to drive the shaft 23, limit switches being provided to limit the extent of rotary movement of the shaft 23 by switching off the motor 35. The limit switches are positioned so that the crank 46 engages the appropriate stop 24 or 25 (FIG. 4) and the residual inertia of the motor is relieved by slipping of the ring 40, the crank 46 being held frictionally in engagement with the respective stop 24 or 25 by the action of the friction ring 44. The combination obtained by the use of two friction rings 40 and 44 of different diameters is of particular importance in that it enables the crank to be held in the position into which it has been moved while at the same time ensuring that the driving belt and motor cannot be overloaded if, because of some slight misadjustment, the crank 46 contacts one of the stops before operation of the associated limit switch has brought the crank substantially to rest. Positive holding of the position of the crank means that movement thereof can be effected in good time before a junction.

The portion of the guideway upstream of the junction in FIG. 5 includes a "on-guideway" operating member for the track selection means in the form of a guide blade 47 which is pivotable by means of a rod connected to an actuating pin 48 about a vertical axis between three positions indicated by lines 49, 50 and 51. In the position shown in FIG. 5, i.e. on line 49, the guide blade 47 is arranged to engage the guide wheel 28 of a carriage to displace the guide wheel 28 transversely of the carriage and to cause the carriage to be routed to the left at the track junction. If, of course, the guide wheel 28 had already been positioned by action of the crank 46 under the control of the motor 35 in readiness for the carriage to be routed to the left, no transverse displacement of the guide wheel 28 would be required. On the other hand, if the blade 47 were in position 51, it would similarly act to route the carriage to the right at the track junction, over-riding any previous setting of the position of the guide wheel 28. The central position 50 of the blade 47, is such as to allow a guide wheel 28 to pass freely on either side thereof, and is thus the inoperative position of the blade 47, the route taken of the carriage being then determined solely by the setting of the track selection operating means on the carriage.

In a section of the guideway afforded by the beam 1 between the blade 47 and the junction, where the guide surfaces 29 and 34 are omitted, a coded array unit 52 is provided which transmits an unchaging batch of coded destination symbols to all passing vehicles, which have on-board means for recognizing the signals and responding thereto. Before a junction such as that shown in FIG. 5, the blade 47 is set to route all traffic on to the "main" line, i.e. the line which carries the most traffic. However, before starting its journey, each vehicle is allotted a destination symbol that comprises coded information together with means to enable the vehicle to identify that particular symbol and to distinguish it from symbols corresponding to other destinations. The coded array unit 52 transmits an unchanging package of destination symbols to every vehicle and this package comprises the symbols corresponding to the destinations that are reached by travelling along the "branch" line, i.e. by leaving the main line.

Thus, whenever a vehicle receives its own destination symbol, the on-board track selection operating means is activated, causing the motor 35 to move the crank 46 into the position corresponding to the vehicle moving on to the "branch" line as opposed the "main" line. Thus the mode of operation of a vehicle leaving the "main" line includes having the track selection mechanism automatically pre-set to the position corresponding to continued travel along the "main" line by the "on-guideway" operating means, whereafter the track selection mechanism is reset by the "on-board" operating means during travel of the vehicle along the portion of the guideway which guide surfaces 29 and 34 have been removed.

Previous proposals have been made which have involved either solely "on-board" switching or solely "on-guideway" switching and brief reference will be made to FIGS. 6 to 9 which illustrates the limitations of these previous proposals.

FIG. 6 illustrates a converging junction at which two guideways 53 and 54 lead to a single guideway 55. All carriages whose general mechanical construction is as described above with reference to FIGS. 1 to 4, must select the outer support surface before they reach the junction and, with a system having no provision for "on-guideway" switching, failure to do so, for example, as a result the failure of the motor 35, will result in the operation of safety devices which might cause the particular carriage to be halted. However, the provision of fixed on-guideway switch blades 56 and 57 ensures that any failure of the "on-board" switching means does not result in stoppage of the carriage since correct positioning of the on-board track selection operating mechanism is ensured by the blades 56 and 57. The blades 56 and 57 do not need to move since all passing carriages are routed in the same direction.

FIG. 7 illustrates a diverging junction at which separate vehicles 58 forming a train are uncoupled and routed either along a "main" line 59 or along a branch line 60. It is quite clear that, however efficient an on-guideway switching or track selection operating means might be, it could not cope safely and speedily with such a situation and that on-board track selection operating means is essential.

FIGS. 8 and 9 show "cascades" of switches at the entrance to a station comprising a number of parallel guideways 61 to 64, such stations being necessary for the handling of large numbers of people such as occur at football stadiums and other areas of demand concentration. When track selection is effected by on-board means, guideway sections 65 must be provided between each switch position, to enable the correct operation of the track selection mechanism to be checked and the train stopped if the mechanism has not operated as required before the train reaches the next switch. On the other hand, when on-guideway switching is used, the switch blades may be preset before the arrival of each train, allowing the relatively compact station entry arrangement shown in FIG. 8, only a single guideway section 65 being needed.

An important advantage of the invention is that, by arranging for the on-guideway switching means to be able to change the setting of the on-board switching means, an important built-in safety factor is assured.

In addition, by arranging for the on-board switching means to be capable of operating after the on-guideway switch means has operated, the on-guideway switching means can, in effect, be over-ruled by the on-board switching means.

Under normal circumstances, all traffic will move in one direction only over a specified section of guideway so that control of traffic flow is facilitated. A further safety feature is that means may be provided whereby a vehicle which has broken down for any reason can be towed or pushed to a siding by another vehicle, the on-guideway switching means being used to route both vehicles. The reason for this is that all failures are assumed to be total failures, i.e. that the on-board switching means of the broken-down vehicle are inoperative and that the vehicles will not respond to signals transmitted by the coded array unit 52 of FIG. 5.

FIG. 10 is a schematic plan view illustrating a modified form of the invention, for application to a conventional railway such as a light railway, of the kind normally used for urban and other special conditions. The carriages or bogies have normal railway-type wheels, with flanges and treads of conventional type, the tread being slightly wider than usual. They run on normal running rails, from left to right. FIG. 10 illustrates a junction comprising a left hand main line rail 70, a right-hand approach rail 71, a right-hand main-line rail 72, a right-hand turnout rail 73, following on from the rail 71 and a left-hand turnout rail 74 which crosses the rail 72 according to usual railway practice. The right-hand approach rail 71 is outwardly cranked at a location 75 so that the gauge is fractionally increased in the following track. This is accommodated by the aforesaid widened treads of the wheels and makes possible a limited degree of transverse movement of the wheels, towards the right-hand side, when required.

Clearances are provided between the rails 70 and 74 at 77, and between the rails 71 - 73 and 72, at 78.

Additional guide surfaces 79 and 80 are provided in the vicinity of the junction. These are not present between junctions. They are just above the level of the support rails, so that they would lie within the gauge limits for most conventional railways, and the rolling stock is provided with sufficient clearance underneath to pass over them. Their function is similar to that of the guide surfaces 29 and 34 of FIG. 5.

FIG. 10 shows only those parts of a carriage or bogie, traversing the junction illustrated, which are necessary for explaining the invention. A vertical crankshaft 81, with a crank 82 at its lower extremity, is mounted on the bogie or carriage. A guide wheel 83 is mounted on a downwardly projecting pin attached to the crank 82 so that the wheel 83 lies in a horizontal plane, just clear of the level of the support rails. The wheel 83 is sited close to, or slightly in front of the longitudinal mid-point of the bogie or carriage so as to be movable about the longitudinal center line thereof. The crankshaft 81 and wheel 83 form a vehicle-mounted track selection mechanism, similar to the mechanism comprising the shaft 23 and wheel 28 hereinbefore described with reference to FIGS. 1 to 5. It is angularly movable between positions defined by stops 84 and 85 and represented by lines 86 and 87, either by an on-board mounted motor, or by on-guideway blade, again generally as hereinbefore described.

FIG. 10 shows the track selection mechanism in the position to route the vehicle to continue along the main line. The guide wheel 83 has engaged guide surface 79, thereby constraining the support wheels (not shown) of the bogie or carriage to the left. The flanges of the left-hand wheels will pass through the gap 77 while the treads of the right-hand wheels will bridge the gap due to the increased gauge in the region following location 75. Once clearances 77 and 78 have been passed, the special guide surfaces 79 and 80 are no longer required, and are discontinued. Appropriate lead-in and lead-out surfaces are provided to avoid shock on engagement and disengagement by the wheel 83.

If, on the other hand, the vehicle were to be routed to the turnout, then the crankshaft 81 would previously have been moved, by on-board or on-guideway means, to the position represented by the line 87, thereby causing the guide wheel 83 to engage the guide surface 80, constraining the bogie bodily to the right, the flanges of the right-hand wheels would then pass through the gap at 78, while the treads of the left-hand wheels would bridge the increased gauge. Preferably the guide wheel 83 is slightly in front of the center of the bogie or carriage, so that it tends to guide the front wheels first, and the rear wheels following with an element of steering.

In other respects, this arrangement would conform to normal railway practice, and/or what has been described before with the exception that, in case when a junction is to be used in the trailing direction only, no special guide surfaces 79 and 80 are necessary, the vehicles passing the junction without any associated movement of the track-selection mechanism.

FIG. 11 shows a modification, applied to the junction shown in FIG. 10, whereby whole trains may be routed by the locomotive driver, without stopping the train. This would be an advantage for some light railways and shunting yards. A blade 89 similar in function to the blade 47 of FIG. 5 is pivotally mounted on a vertical pin 90 adjacent to the guide surfaces 79 and 80. The blade 89 is coupled by rods 91 and 92, through bell-cranks 93 and 94, actuating rods 95 and 96 and thereby to combined crank-can members 97 and 98. The cramk-cam members 97 and 98 are alternatively operable by engagement with locomotive-mounted rollers 99 and 100. Means is provided whereby one or other of the rollers 99 and 100 may be selectively raised and lowered as required.

For example, if with a train moving from left to right, the roller 99 is lowered and the roller 100 is raised, the roller 99 engages the cam member 97, thereby rotating said cam member 97 in a clockwise direction. The rod 95 is thereby moved to the right, the bell-crank 93 in a clockwise direction and the rod 91 transversely downwards. The blade 89 is thereby positioned to switch the whole train to the left.

By a corresponding sequence, if the roller 99 is raised, and the roller 100 lowered, the train is switched to the right. A track selection crankshaft 81 and wheel 83, would be provided on each vehicle or bogie, as hereinbefore described. However, they need not necessarily be provided with means for on-board operation.

For passage in the trailing direction, the on-board track selection means would not be necessary, but it might be positioned by lead-in surfaces such as 101 and 102 (FIG. 10).

An incidental advantage of this system of switching is some extent of immunity from icing.

In one form of this invention, the various vehicles are provided with means for coupling and buffering, whereby coupling automatically takes place when vehicles come into end-to-end contact. Uncoupling may take place either by reason of the transverse relative motion between the vehicles concerned, when adjacent vehicles diverge to different sides of a turnout, as shown in FIG. 7, or when both vehicles are waiting at a station, and it is desired to move off the leading vehicle only. Referring again to FIGS. 1, 2 and 4, the carriage 4 is mounted in such a way that it cannot be thrown transversely to the guideway, nor fall from it, in case of collision. The carriage 4 comprises a rigid compression member, with a buffer 109, 110 at each end, whereby compression loads are transmitted between adjacent carriages. The buffers 109 and 110 are wide and curve laterally so that they slide over each other, without premature disengagement, when diverging commences.

High capacity urban systems using vehicles which have a relatively small turning circle, can obtain operational advantages from on-way guideways, and also from moving each vehicle so that the same ends are always the front and back respectively. Sidings and link ends must then always be provided with continuations for return loops without reversal. If this is done, then the front coupling member may be different from the rear coupling member, as in the embodiment which is now described.

The front of each carriage 4 is provided with a coupling wheel 111, whose periphery comprises part of a spherical surface. This is mounted for free rotation about an approximately vertical axis, on a rocker 112 which is pivotably mounted on a horizontal shaft 113. The rocker 112 is normally constrained upwards, by a spring 114 represented by an arrow, and it may be moved downwards by a cam, 115. Mounted at the rear of each vehicle is an open-ended transverse channel coupling member 116. This comprises a plane transverse preliminary buffering surface 117, a suitably inclined ramp member 118, and a transverse cylindrical surface 119 of substantially the same radius of curvature as the coupling wheel 111 and whose axis is transverse and at the same height as the center of the said wheel. When the rear coupling is engaged with the front coupling of a following vehicle, the top surface 120 is at a sufficient height to provide a clearance from the roller 111 when the coupling is in tension. The preliminary buffering surface 117 extends below both the ramp and the cylindrical surface 119.

The channel member 116 is mounted on rods 121 and 122 which are slideably mounted in the frame of the carriage and constrained by springs to intermediate positions within their range of longitudinal travel.

When vehicles are brought into end-to-end contact, the coupling wheel 111, at the front of the rear vehicle, first engages ramp 118 of the leading vehicle. The wheel 111 is thereby depressed, causing pivoting of the rocker 112 about the shaft 113, thereby compressing the spring 114. When the wheel clears the ramp surface 118, it is lifted by the spring 114, to engage the channel member 116 and contact the top surface 120 thereof. As the vehicles continue to move together, the roller engages the preliminary buffering surface 117, thereby displacing the channel member 116, until the buffers 109 and 110 establish contact and carry the main buffering load.

Loads in tension are transmitted between the coupling wheel 111 of the following vehicle, and the cylindrical surface 119 of the leading vehicle. The springs constraining the channel member 116 reduce shock, and may be preferably stiffer in tension than in compression, because, whereas they carry the main coupling loads in tension, they only carry preliminary buffering loads.

In contrast to railway-type couplings which tend to interfere with the suspension of individual vehicles, the coupling described above provides freedom of movement, both angular and translational, between coupled vehicles.

Up and down relative motion is accommodated by the pivoting of the rocker 112 about the shaft, together with the rotation of coupling wheel 111 inside cylindrical surface 119. When the coupling is disengaged, as shown in FIG. 2, the spring 114 holds the rocker 102 in contact with cam 115. When engaged and transmitting tension, the coupling wheel 111 is automatically brought into a position when its center lies substantially on the axis of the cylindrical surface 119; in this position clearance is provided between the rocker 112 and the cam 115 as well as between the coupling wheel 111 and the top surface 120 of the channel member 116. This remains true even if a tension load contains substantial vertical components.

Sideways relative motion is, of course accommodated by the transverse rolling of the coupling wheel 111 within the channel member 116 and/or associated sliding between engaged buffers.

Angular relative motion in a vertical plane between adjacent vehicles also displaces the couplings vertically. It is permitted by a combination of the rolling of the coupling wheel 111 within the channel member 116 in a vertical plane, and the pivoting of the rocker 112 about the shaft 113. Transverse angular relative motion is accommodated by the rolling of the wheel 111 about its own axis.

When coupled vehicles select different sides of the same turnout, then the coupling wheel 111 of the following vehicle will move transversely until it leaves the end of the channel member 116 of the leading vehicle. As it does so, the channel member 116 might experience transverse loading, if the coupling was loaded. Such transverse loads may be prevented from becoming excessive by mounting the rocker 112 so as to allow a little transverse movement. For example, the transverse shaft 113 may be provided with limited axial free play at its ends 123 and 124. It may be constrained towards its central position by light springs 125 and 126, represented by arrows in FIG. 4.

Uncoupling can also be accomplished, by the operation of the cam 115. This may be rotated by a motor mounted on the same shaft as the cam 115, with suitable actuating controls and limit switches. During disengagement the rocker 112 is depressed until the coupling wheel 111 is clear of the cylindrical surface 119. Such disengagement is envisaged as taking place between vehicles waiting at a station with their buffers in contact so that the coupling is lightly loaded in compression. The coupling wheel 111 then remains in contact with that portion of preliminary buffering surface 117 which extends below the cylindrical surface 119. It therefore remains in the correct position for recoupling, by further rotation of the cam 115, at any time before the leading vehicle moves off.

Since there must be clearance for the coupling wheel 111 to leave the recess formed by cylindrical surface 119 and preliminary buffering surface 117 there is some longitudinal free play when the coupling is in the engaged position. Any shock which might be introduced thereby is to be reduced by the springs on the slideably mounted coupling channel support rods 121 and 122. Such shock can be further reduced if all vehicles are self-propelled and controlled to maintain approximately the same speed.

Couplings as described above have the further advantages that they are protected from the weather, and rigidly linked to the guide wheels, so that any transverse loads associated with diverging do not appreciably tend to displace them sideways. The fact that coupling normally takes place before buffering provides a little latitude when stopping vehicles for coupling. As an alternative, it would be possible to have both coupling members the other way up, i.e. with the wheel 111 beneath the rocker 112. The coupling link would then be maintained by gravity, so that the spring 114 could be omitted.

It is unusual to use single rigid carriages for a monorail system because the center and/or the ends may be displaced laterally on curves, thus the side walls of the guideway have to provide increased clearance on curves, and cannot be used for guidance purposes. One existing construction does use a single carriage, but guidance is by a support wheel, with a central flange, and thus it cannot negotiate very small radius curves. A feature of the construction described above is that separate horizontal guide wheels are provided at each end of the rigid carriage but they engage special vertical guide surfaces, thereby overcoming these problems.

I claim:

1. A transportation system comprising a guideway, a diverging junction on said guideway, a vehicle movable along said guideway, guidance means for affording guidance to said vehicle for travel thereof to either side of said junction, vehicle-mounted track selection means for selecting which side of the junction the vehicle is to follow, an on-board operating member, an on-guideway operating member and means whereby said track selection means is, at all times, independently operable alternatively by said on-board operating member and by said on-guideway operating member, and retained in position to select a chosen side of the junction until changed by either of said operating members, whereby the setting of the track selection means at any time depends solely on which of the operating members has most recently been encountered.

2. A transportation system according to claim 1, in which the on-guideway operating member is arranged to change the setting of the track selection mean, should said on-board operating member be set to direct the track selection means to a different side of the junction from that to which the on-guideway operating member is set.

3. A transportation system according to claim 1, in which said track selection means comprises a vertical crankshaft and a horizontal guide wheel mounted on the crankshaft, and said on-guideway operating means comprises a movable switch blade operable on the guide wheel.

4. A transportation system according to claim 1, in which said vehicle is a suspended monorail vehicle having suspension means whereby it is temporarily supported from one side only, as it passes the junction.

5. A transportation system according to claim 1, in which said vehicle is supported from beneath by flanged wheels running on rails, permanent clearance being provided between a on-board leading to one side second the junction and a rail leading to the other means, of the junction.

6. A transportation system according to claim 1, further comprising a first friction device adapted to retain said track selection means in a chosen position and said onboard operating member comprises a section friction device for imparting movement to said track selection mean, the friction exerted by said second friction device being greater than that exerted by said friction device.

7. A transportation system according to claim 6, wherein said first friction device comprises a friction ring and said second friction device comprises a friction ring of greater diameter than the friction ring of said first friction device, common spring means being provided for simultaneously applying the same thrust to both friction devices.

8. A transportation system comprising a guideway, a diverging junction on said guideway, two vehicles movable along said guideway, guidance means for affording guidance to said vehicles for travel thereof to either side of said junction, vehicle mounted track selection means for selecting which side of the junction each vehicle is to follow, and an on-board operating member for operating said track selection means, wherein each vehicle has a buffer and a coupling member at one end. one of the coupling members comprises a roller with a part-spherical surface and a vertical axis, and the other coupling member has a part-cylindrical surface which is a portion of a cylinder having a radius of curvature in a vertical plane which is substantially the same as that of the part-spherical surface and adapted to be engageable therewith when the coupling formed thereby is in tension, the sides of the part-cylindrical surface of said other coupling member being unbounded whereby if the vehicles select and follow different sides of a junction, they automatically become uncoupled by the transverse relative motion of said roller relative to said part-cylindrical surface.

9. A transportation system according to claim 8, in which said other coupling member also has a ramp surface, arranged to guide said roller into engagement with said part-cylindrical surface as the vehicles approach each other, and a surface which confronts the part-cylindrical surface so as to abut against the opposite side of the roller and said other coupling member is constrained in a longitudinal direction, so that, as two vehicles approach each other, coupling automatically takes place before buffering.

10. A transportation system according to claim 9, further comprising a rocker on which said roller is mounted, said rocker which is pivotable about a transverse horizontal axis, being usually constrained in a direction to cause the roller to engage with the corresponding coupling member, but provided with means whereby it may automatically be constrained in the opposite direction to effect uncoupling.

11. A transportation system according to claim 8, in which each vehicle comprises a rigid structure with a coupling and a buffer at each end, which structure is located inside a hollow guideway.

* * * * *